United States Patent [19]

Bodle et al.

[11] Patent Number: 4,692,238

[45] Date of Patent: Sep. 8, 1987

[54] SOLVENT EXTRACTION OF ORGANIC OILS AND SOLVENT RECOVERY

[75] Inventors: William W. Bodle, Deerfield; Paul B. Tarman, Elmhurst, both of Ill.

[73] Assignee: Institute of Gas Tehnology, Chicago, Ill.

[21] Appl. No.: 895,724

[22] Filed: Aug. 12, 1986

[51] Int. Cl.[4] ..... C10G 1/00

[52] U.S. Cl. ..... 208/407; 208/432; 208/431; 208/427

[58] Field of Search ..... 208/400, 427, 424, 430, 208/431, 390, 435, 432, 407

[56] References Cited

U.S. PATENT DOCUMENTS

| | | | |
|---|---|---|---|
| 1,123,222 | 1/1915 | Behnke et al. | 34/15 |
| 2,133,280 | 10/1938 | Burk | 196/14 |
| 2,173,842 | 9/1939 | Horner | 196/14 |
| 2,487,788 | 11/1949 | Buchan | 196/56 |
| 3,392,455 | 7/1968 | Kingsbaker, Jr. et al. | 34/36 |
| 4,139,450 | 2/1979 | Hanson et al. | 208/11 LE |
| 4,160,718 | 7/1979 | Rendall | 208/390 |
| 4,238,315 | 12/1980 | Patzer | 208/11 LE |
| 4,401,551 | 8/1983 | Mitchell | 208/390 |
| 4,409,090 | 10/1983 | Hanson et al. | 208/390 |
| 4,415,442 | 11/1983 | Rhodes | 208/424 X |
| 4,495,057 | 1/1985 | Amirijafari et al. | 208/390 |
| 4,532,024 | 7/1985 | Haschk et al. | 208/390 |
| 4,559,133 | 12/1985 | Siegfried et al. | 208/424 X |

FOREIGN PATENT DOCUMENTS 654753 11/1948 United Kingdom .

*Primary Examiner*—Andrew H. Metz
*Assistant Examiner*—Glenn Caldarola
*Attorney, Agent, or Firm*—Thomas W. Speckman

[57] ABSTRACT

A process for recovery of organic oils and residues in association with inorganic solids by solvent extraction and for the recovery of solvent used for the extraction. The organic solvent extracted inorganic solids having remaining associated organic solvent is fluidized in a bed with fluidizing gas comprising superheated vapor of the organic solvent vaporizing and removing a substantial portion of the associated organic solvent. Then the solids are countercurrently contacted with a combustion gas stream at a lower temperature than the solids physically stripping a substantial portion of the residual solvent from the solids, the combustion gas stream being enhanced for combustion by comprising stripped organic solvent and by being heated.

22 Claims, 1 Drawing Figure

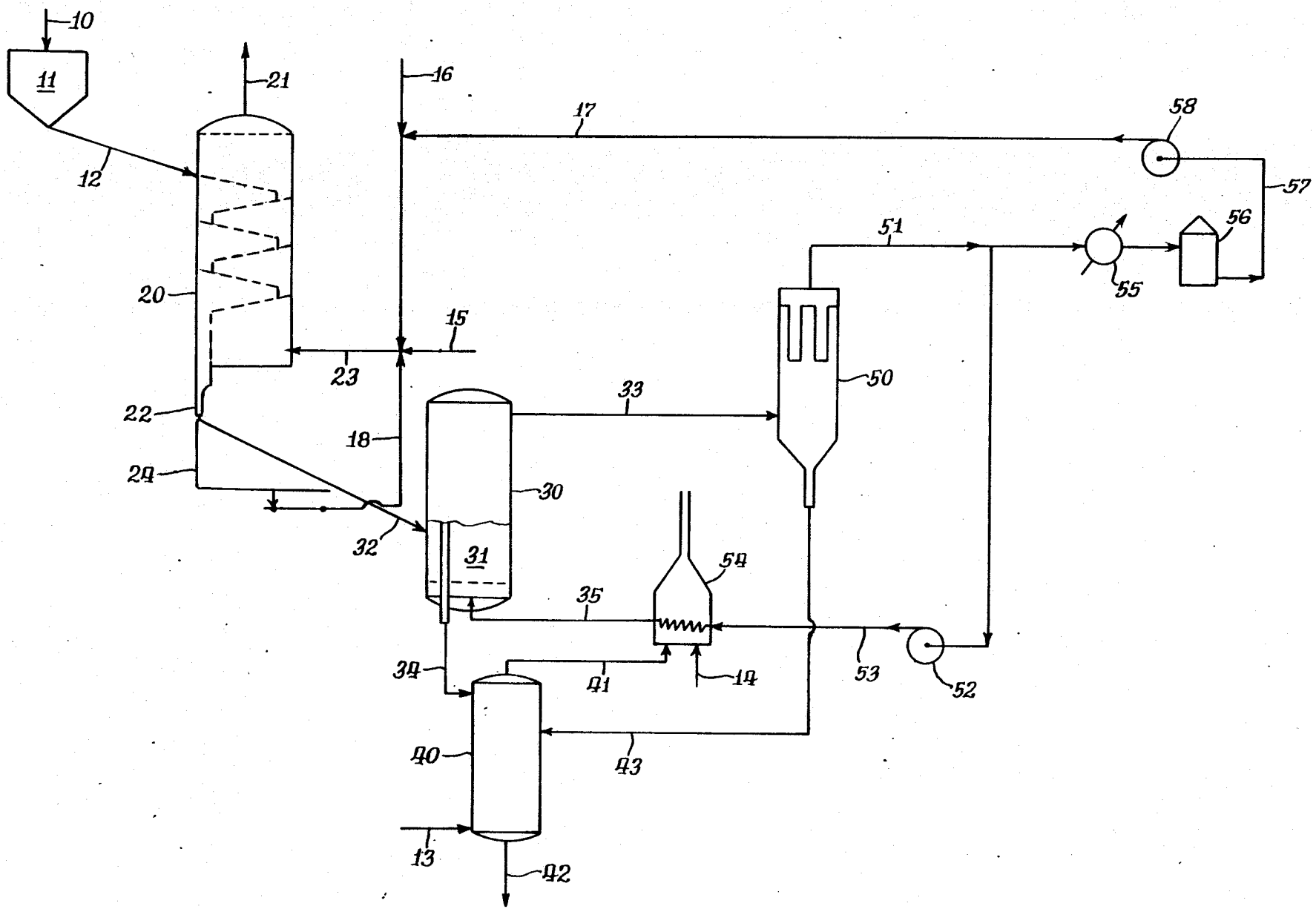
10
11
12
13
14
15
16
17
18
20
21
22
23
24
30
31
32
33
34
35
40
41
42
43
50
51
52
53
54
55
56
57
58

SOLVENT EXTRACTION OF ORGANIC OILS AND SOLVENT RECOVERY

BACKGROUND OF THE INVENTION

1. Field of the Invention

This invention relates to a process for the recovery of organic oils and organic residues from inorganic or mineral solids by solvent extraction, and for the recovery of solvent used for the extraction.

2. Description of the Prior Art

The removal of organic oils and residues from mineral solids, such as sand, sandstone, shale, limestone and other porous mineral materials, is a commerically desirable process. The raw material is abundant, and extracted organic oils and residues may be utilized as fuel. Prior art methods to recover oils and residues from such mineral materials have not achieved satisfactory efficiency.

One method for removing organic oils from mineral solids is to heat the oil containing solids and separate organic oils and residues by distillation. Utilization of this method, however, causes a substantial portion of the organic oils to decompose due to the high temperatures required for distillation. The internal structure of the inorganic material being treated may also be altered by the high temperatures resulting in trapping of the organic oils.

Another method of extracting organic oils and residues from mineral solids is to wash the oil containing solids with hot water, thereby extracting organic oils to the water phase. The emulsion of oil in water is difficult to separate, and the overall process is slow and inefficient.

Various solvent extraction systems are known to the art. Some solvent extraction systems are used in combination with hot water treatments, while others provide solvent extraction without addition of water. British Pat. No. 654,753, for example, teaches a solvent extraction method wherein bituminous coal is immersed in ethylene dichloride. Solvent is removed from the treated coal by draining and/or centrifuging, and by evaporation when the coal is subsequently dried and the solvent recovered from the oil by distillation.

U.S. Pat. No,. 4,238,315 teaches a process for recovering oil from oil shale containing kerogen by heating in the presence of an organic solvent to a temperature in the range of about 385° to 440° C. under elevated pressure of 250 to 2000 psig and thereafter recovering the extracted oil. Solvent and oil are separated from the spent shale by filtration, settling, or centrifuging and solvent is separated from the oil by factionation. U.S. Pat. No. 4,139,450 discloses a process for solvent extraction of bitumen from tar sands by a substantially "water-free" process wherein tar sand is first mixed with a hot solvent such as toluene at 180° to 280° C. to evaporate water from the tar sands. The bitumen and solids are separated by settling and filtration or centrifugation of fines and hot organic solvent vapors recycled to the feed mixer for heat exchange with incoming tar sands. Residual organic solvent is steam stripped from the bitumen and the solvent recycled.

U.S. Pat. No. 2,487,788 teaches a process for treating kerogen containing shale with a hydrocarbon oil at 375° to 425° C. to convert kerogen solids to predominantly liquid products which are miscible in the oil. Any remaining oil associated with the treated shale may be recovered by displacement with steam or gases. The oil products are subsequently fractionated to separate components as desired.

U.S. Pat. No. 2,173,842 teaches a process for solvent extraction of organic oils from mineral solids by forced displacement and forced circulation of solvent through pores followed by vaporization and then repeating the cycle.

U.S. Pat. No. 2,133,280 teaches solvent extraction of oil products from mineral solids using a non-oleaginous solvent followed by treatment of the mineral residue with a petroleum solvent.

U.S. Pat. No. 3,392,455 teaches a process for solvent extraction of oils from solids, such as from soybeans, with removal of a major portion of solvent from the solids by thermal treatment with vaporized solvent and pressure variation by movement through a desolventizer by a spiral lifting cage conveyor. Residual solvent, up to 10 percent of the solvent entrained, may be reduced by stripping with fresh, clean steam resulting in solvent contaminated steam which requires further treatment for recovery of solvent.

U.S. Pat. No. 1,123,222 teaches a solids rotatable drum drier utilizing heated air or products of combustion for drying solids.

Organic solvent extraction of oils and organic residues from inorganic or mineral solids without the addition of water is preferable to aqueous extraction of oils which requires further separation of oil from the water.

SUMMARY OF THE INVENTION

It is an object of the present invention to provide a dry process for solvent extraction of organic oils and residues from inorganic or mineral solids utilizing a solvent extraction reactor operating in conjunction with means to provide high recovery of solvent in useful form from the extracted solids having solvent associated therewith.

It is another object of the present invention to provide a process for high recovery of organic solvent from solvent extracted inorganic solids having remaining associated organic solvent by fluidizing a bed of the solvent extracted solids with fluidizing gas comprising superheated vapor of the organic solvent vaporizing an additional portion of the associated organic solvent.

It is yet another object of this invention to provide a process for recovery of organic solvent from solvent extracted inorganic solids having remaining associated organic solvent by countercurrently contacting the solvent extracted inorganic solids with a combustion gas stream, such as combustion air, at a lower temperature than the solids thereby stripping solvent from and cooling the solids.

It is another object of this invention to recover sensible heat from spent solids and to utilize the sensible heat recovered in the solvent extraction and recovery process.

It is yet another object of this invention to provide an energy efficient process for extracting desirable organic oils and residues from organic carbonaceous solids.

It is an object of this invention to provide a process for removing combustible materials from any spent solids prior to disposal.

It is still another object of this invention to provide an organic solvent extraction process wherein no water is added in the solvent recovery.

The process of the present invention is applicable to mineral solids containing organic oils and/or organic residues, such as oil shale, limestone or sandstone containing organic oils or residues, tar sands containing bitumen or tar, peat and lignite containing waxes or oils, and any spent solids containing combustible materials and mixtures thererof. The process provides for the extraction and recovery of organic oils and residues from mineral solids, and provides efficient solvent recovery and solvent recycle and utilization without the requirement of added water or steam which requires additional clean-up steps.

Organic oils and residues are distributed throughout the pores and interstitial spaces within inorganic solids. According to the process of the present invention, feed solids are crushed to a relatively fine size, and screened to insure relatively uniform size suitable for fluidization. Suitable average solid particle diameters are about 0.01 to about 0.25 inch, preferably about 0.1 to about 0.2 inch. Preparatory size reduction provides a greater solids surface area for solvent extraction, and exposes organic oils and residues for solvent extraction.

Crushed and screened solids, at approximately ambient temperatures, are introduced near the top of a solvent extraction reactor wherein downwardly flowing solids are contacted with upwardly flowing organic solvent. Organic solvents or any mixture of solvents in which the desired product oils and/or residues are soluble are suitable for use with the process of this invention. Suitable organic solvents may include aromatic compounds, such as benzene, phenol, quinone and quinoline; hydroaromatic compounds such as tetralin, hydrophenanthrenes, and hydroanthracenes; aliphatic compounds such as hexane, cyclohexane, decane and cetane; alcohols, such as isopropanol and ethylene glycol; ketones, such as methyl ethyl ketone; and mixtures of organic compounds, such as product oil, shale oil, diesel oil, coal liquids, anthracene oil, chloroform, carbontetrachloride, methylchloride, and formaldehyde.

Downflowing inorganic solids are countercurrently contacted with upflowing liquid organic solvent in any suitable liquid/solid contact reactor. One suitable staged reactor is equipped with a plurality of perforated trays or pan-s to insure even distribution of solids in the liquid solvent. As solids flow downwardly from one stage to the next, individual solid particles are in motion and their surfaces are in contact with upwardly flowing solvent. A large portion of the organic oils and residues in the inorganic solids are thus dissolved in the upwardly flowing organic solvent.

Organic solvent with dissolved organic oils is removed near the top of the solvent extraction reactor and organic oils are subsequently separated from the solvent by suitable methods which are well known to the art and which do not alter the chemical structure of either organic oils or solvent. Organic solvent may be redistilled and recycled for use in subsequent solvent extractions. Solvent extracted solids and organic solvent associated therewith are withdrawn from a lower portion of the solvent extraction reactor. A substantial quantity of solvent remains associated with the solids and simple draining of the solids does not provide efficient solvent recovery. Draining may be incorporated in the process of this invention to remove a portion of the excess solvent. In the order of about 15 to about 25 percent of the solvent is removed by draining.

According to the process of the present invention, solvent extracted solids and associated solvent are conveyed to and introduced into a fluidized bed solvent recovery contactor wherein solvent extracted solids are fluidized by a fluidizing gas comprising superheated vapor of the organic solvent and heated to a temperature which is sufficient to vaporize an additional portion of the associated solvent. The solids are rapidly heated in the fluidized bed and solvent adhering to or in the pores of the solvent extracted solids is vaporized by contact with superheated fluidizing solvent vapor. A substantial portion of solvent associated with the solvent extracted solids is vaporized in the fluidized bed, more than about 95 percent of the remaining organic solvent being removed in the fluidized bed solvent recovery contactor. The temperature of fluidizing superheated solvent vapor will vary, depending upon the temperature at which the solvent utilized for the extraction vaporizes. The fluidized solids are rapidly heated by fluidizing superheated solvent vapors to a temperature lower than the temperature of the fluidizing gas.

Fluidizing gas ehtrains additional vaporized solvent which is discharged near the top of the reactor. Recovered solvent is subsequently processed through internal and external dust removal equipment. One portion of the dust free recovered solvent vapor may be recirculated through the fluidizing solvent vapor superheater and reintroduced at the base of the fluidized bed contactor to provide fluidizing solvent vapors. A second portion of the recovered solvent may be condensed and stored in a liquid surge tank for reuse. Liquid solvent may be recycled to the solvent extraction reactor to provide additional solvent for the solvent extraction process.

Solids from which solvent has been vaporized in the fluidized bed solvent vapor recovery contactor still contain residual solvent in pores and interstitial spaces. Residual solvent, in the order of less than about 4 percent of the solvent associated with the solids introduced into the fluidized bed solvent recovery contactor, and generally less than about 2 percent, are preferably removed prior to disposal of the spent solids. Spent solids otherwise may pose environmental and fire hazards. To remove residual solvent, spent solids discharged from the fluidized bed contactor are conveyed to a solids/-combustion gas contactor. Combustion gas includes any oxidizing gas for combustion, such as air or other oxygen containing or oxygen enriched gas. Solids are introduced near the top of a vertically oriented solids/combustion gas contactor, and fall downwardly, countercurrent to an upwardly flowing stream of approximately ambient temperature combustion gas at a lower temperature than the solids. Solvent is stripped from the pores and interstitial spaces of the solids by gas replacement. Stripped solvent is entrained in the upwardly flowing combustion gas stream, discharged near the top of the solids/combustion contactor, and preferably conveyed to the fluidizing solvent vapor superheater for use as enhanced combustion gas. Sensible heat is also recovered from the solids flowing downwardly through the solids/combustion contactor by heat exchange with the countercurrently flowing combustion gas. Warmed combustion gas with entrained solvent is used as a component of combustion gas in the solvent vapor superheater.

Cooled, solvent free spent solids may be productively utilized or safely disposed.

BRIEF DESCRIPTION OF THE DRAWING

The FIGURE shows a simplified schematic flow diagram of one embodiment of the process of this invention.

DESCRIPTION OF THE PREFERRED EMBODIMENTS

As shown in the FIGURE, mineral solids containing organic oils or residues are conveyed from a source of supply through delivery means 10 to solids crushing, screening and preparation means 11. Feed solids are preferably crushed and screened to provide relatively uniformly sized particles having average sizes about 0.01 to about 0.25 inch in diameter. Desirable particle sizes may vary, depending upon the type of solids feed utilized. Crushed and screened feed solid particles are conveyed through feed solids conduit 12 at about ambient temperature to solvent extraction reactor 20.

Solvent extraction reactor 20 is a staged contactor wherein downwardly flowing feed solids introduced at ambient temperature contact upwardly flowing heated liquid solvent. Solvent extraction reactor 20 is preferably equipped with a plurality of inclined, perforated tray or plate means to assure even distribution and flow of solids in the liquid solvent. Heated liquid solvent is delivered near the base of solvent extraction reactor 20 through solvent feed conduit 23. Make-up or fresh heated solvent is supplied to solvent feed conduit 23 through fresh solvent supply conduit 15. Liquid solvent recovered from product liquids may be recycled through recycle conduit 16, solvent drained from solvent extracted solids may be recycled through recycle conduit 18, and solvent recovered from fluidized solids may be recycled through recycle conduit 17. Solvent for introduction to solvent extraction reactor 20 may be heated by any conventional means to a temperature which achieves substantially complete extraction of organic oils and residues from the mineral solids. This temperature will vary depending upon the solvent utilized, the type of feed solids, and the material being extracted.

Heated liquid solvent intimately contacts downwardly flowing solids, extracting organic oils and residues from feed solids as organic oils are dissolved in solvent. Solvent containing dissolved organic oils is removed near the top of solvent extraction reactor 20 through product withdrawal conduit 21. Extracted organic oils and residues are separated from the solvent by conventional fractionation means which are well known to the art. Separated solvent may be redistilled as necessary and recirculated through solvent recycle conduit 16 and solvent feed conduit 23 to solvent extraction reactor 20.

Solids which have undergone solvent extraction are discharged near the base of solvent extraction reactor 20 through solids withdrawal means 22, drained of solvent in liquid drain means 24, and conveyed by solids conveying means 32 to fluidized bed solvent recovery fluidized bed contactor 30. A substantial quantity of solvent, in the order of about 75 to about 85 percent of the solvent leaving the contactor with the solids adheres to the solids after screening over liquid drain means 24. Solvent still adhering to and in pores of the solids is largely recovered in fluidized bed contactor 30, wherein fluidized bed 31 comprises solvent extracted solid particles fluidized by superheated vaporized solvent as fluidizing medium. Fluidizing solvent vapor is superheated in fluidizing solvent vapor superheater 54 to temperatures above the solvent boiling point, desired temperatures depending upon the type of solvent utilized. Suitable superheat temperatures are higher than about 200° F. above the solvent boiling point, preferably up to about 50° to about 25° F. below the thermal decomposition or cracking temperature of any organic oils or residues remaining in the solids. Solvent vapors are conveyed through superheated solvent vapor conduit 35 and introduced into fluidized bed contactor 30 below fluidized bed 31 to provide heating and fluidizing gas.

Fluidizing gas and additional vaporized solvent recovered from the solids are removed near the top of fluidized bed solvent recovery contactor 30 through solvent vapor withdrawal conduit 33. The gas and vapor are conveyed through solvent vapor withdrawal conduit 33 to solids/vapor separator 50 wherein solids carried off the fluidized bed are removed from the solvent vapor. Separated solvent vapors are conveyed through solvent vapor recycle conduit 51. A portion of the solvent vapors transported through solvent vapor recycle conduit 51 may be diverted to solvent vapor recycle blower 52 and then delivered through vapor recycle conduit 53 to fluidizing solvent vapor superheater 54. Recovered solvent vapors are thus recycled to provide superheated fluidizing solvent vapor. In addition, solvent vapors may be conveyed to solvent vapor condenser 55 and stored in solvent surge tank 56, then recirculated through liquid solvent recycle conduit 57 and liquid solvent recycle pump 58, and solvent recycle conduit 17 to solvent extraction reactor 20. Solids separated in solids/vapor separator 50 are conveyed through solids conduit 43 to solids/combustion gas contactor 40 for further processing.

Solids are withdrawn from fluidized bed contactor 30 through solids withdrawal conduit 34. Feeding and withdrawal of solids to and from fluidized bed contactor 30 is regulated to provide a sufficient retention time of solids in fluidized bed 31 to assure that a major amount of solvent adhering to and associated with the solids is released as vapor. Generally, more than about 95 percent of the organic solvent associated with the solids upon introduction to the fluidized bed is removed in the fluidized bed. Suitable solids retention times in the fluidized bed are about 1 to about 5 minutes, about 2 to about 3 minutes being preferred. Solids rapidly attain a high temperature upon introduction into fluidized bed contactor 30 by the superheated fluidizing solvent vapors.

Solids withdrawn from fluidized bed contactor 30 through solids withdrawal conduit 34 are conveyed to solids/combustion gas contactor 40. The pores and interstitial spaces of the solids discharged from fluidized bed contactor 30 still contain residual vaporized solvent, in the order of less than 5 percent of the solvent associated with the solids leaving the solvent extraction reactor, which is preferably removed from the spent solids prior to safe disposal or productive use.

Solids with associated residual vaporized solvent are introduced near the top of solids/combustion gas contactor 40 from solids withdrawal conduit 34. The solids move downwardly, countercurrent to approximately ambient temperature combustion gas flowing upwardly through solids/combustion gas contactor 40. Combustion air or other gas or mixture of gases which is nonreactive with the solvent vapors and the spent solids is delivered near the base of solids/combustion gas contactor 40 through gas delivery conduit 13. As the combustion gas contacts the downwardly flowing spent solids, it physically displaces vaporized solvent and organic oil from the pores and interstitial spaces in the spent solids. Substantially organic free spent solids are withdrawn from solids/combustion gas contactor 40 through solids withdrawal conduit 42 for safe disposal or for productive utilization. Any contactor providing high solids/gas countercurrent contact may be used, such as a free fall solids contactor or a moving bed solids contactor.

Countercurrent heat exchange takes place between downwardly flowing, heated spent solids and the upwardly flowing gas stream in solids/combustion gas contactor 40. Gas is introduced at approximately ambient temperatures, and is heated as it countercurrently contacts heated spent solids. Vaporized solvent and organic oil which is entrained in the gas stream provides additional heat recovery of thermal energy upon its combustion. Heated combustion gas comprising entrained vaporized solvent and organic oil is withdrawn from contactor 40 through withdrawal conduit 41 and conveyed to solvent vapor superheater 54 where the preheated combustion gas with entrained vaporized solvent and oil may be utilized in combustion with combustible fuel delivered from fuel delivery conduit 14 to provide thermal energy to superheat fluidizing solvent vapors. In this manner, a substantial portion, of the residual solvent and organic oils remaining in association with the inorganic solids after its major separation in the fluidized bed solvent recovery contactor is recovered for use and inorganic solids retaining generally less than about 1 to about 2 percent of the solvent associated with the solids leaving the solvent extraction reactor are suited for reuse or safe disposal.

The process of this invention is suitably carried out at ambient pressures throughout, thereby reducing the need of pressure control equipment required by many prior processes which rely upon pressure changes for removal of solvent associated with solids following solvent extraction. The process of this invention is a "dry" solvent recovery process in which no added moisture is used for solvent recovery, such as prior processes which use steam stripping for removal of organic solvents from solids.

While the preferred embodiments have been specifically described with respect to recovery of organic oils and residues from inorganic solids, it can be readily appreciated by one skilled in the art that the process is equally applicable generally to removal of combustible materials from any spent inorganic solids to render the solids suitable for disposal.

The following example sets forth specific materials and embodiments in detail and is intended to exemplify the invention only and not to limit it in any way.

EXAMPLE

Organic oils may be recovered from tar sands utilizing the process of the present invention. Mass transfer and thermal calculations were made using a commercial scale solvent extraction and recovery process as shown schematically in FIG. 1 wherein tar sand is delivered to a solvent extraction reactor witn six inclined, perforated trays at the rate of 2,624,000 lbs/hr containing 2,459,000 lbs/hr mineral sand and 165,000 lbs/hr organic oils. The tar sand is introduced at ambient 65° F. temperature. The tar sand is passed countercurrently to 1,359,000 lbs/hr liquid hexane solvent introduced at about 160° F., 120,000 lbs/hr from screen 24 and 1,239,000 lbs/hr from other recycle. Hexane solvent is discharged near the top of the extraction reactor at the rate of about 744,000 lbs/hr containing dissolved oil at 149,000 lbs/hr. Spent sand is discharged near the bottom of the extraction reactor at the rate of about 2,459,000 lbs/hr with 615,000 lbs/hr hexane solvent and 16,080 lbs/hr organic oil at 145° F. Simple screen drainage obtains the recovery of 120,000 lbs/hr hexane solvent for recycle to the solvent extraction reactor.

2,439,000 lbs/hr sand with associated 16,000 lbs/hr organic oil, and 495,000 lbs/hr hexane solvent at 120° F. is added to a fluidized bed solvent recovery contactor wherein solids are contacted by 721,000 lbs/hr fluidizing hexane vapors superheated to 500° F. 491,200 lbs/hr hexane solvent associated with the sand is vaporized and entrained with the superheated fluidizing vapors. 2,458,000 lbs/hr sand at a temperature of about 200° F., with associated 16,000 lbs/hr organic oil and 3,800 lbs/hr hexane is removed from the fluidized bed and passed to the solids/combustion gas contactor.

Fluidizing hexane vapor with additional vaporized hexane is discharged from the upper portion of fluidized bed contactor and separated from 1000 lbs/hr entrained solids. A portion of the vaporized hexane, 721,000 lbs/hr, is recycled to the fluidizing vapor superheater and heated to 500° F. to provide superheated fluidizing gas of the solvent. The remainder of the vaporized hexane, 491,200 lbs/hr, is condensed and recycled to provide liquid solvent for feeding to the solvent extraction reactor.

Sand is discharged from the fluidized bed solvent recovery contactor at the rate of 2,458,000 lbs/hr with residual associated 16,000 lbs/hr oil and with about 3,800 lbs/hr hexane. Spent sand with adhering and associated residual organic oil and solvent, at 200° F., is countercurrently contacted with 3300 lbs/hr ambient temperature air in a solids/combustion gas contactor. Heated combustion air and stripped organic oil and hexane are combusted with a fuel to provide heat to fluidizing solvent vapor superheater. Spent sand is discharged from the solids/combustion gas contactor with very low organic content, at least greater than 85 percent and preferably greater than 99 percent of the organic materials having been removed.

While in the foregoing specification this invention has been described in relation to certain preferred embodiments thereof and many details have been set forth for purpose of illustration, it will be apparent to those skilled in the art that the invention is susceptible to additional embodiments and that certain of the details described herein can be varied considerably without departing from the basic principles of the invention.

We claim:

1. A process for solvent extraction of organic oils and residues in association with inorganic solids and solvent recovery comprising the steps of:

countercurrently contacting said solids with upflowing liquid organic solvent in a staged solvent extraction reactor;

withdrawing said liquid solvent having a substantial portion of said organic oils and residues dissolved therein from said solvent extraction reactor, separating said organic oils and residues from said solvent, and recycling liquid solvent to said solvent extraction reactor;

withdrawing liquid solvent extracted solids having a substantially reduced portion of said organic oils and residues in association therewith and solvent associated therewith from said solvent extraction reactor and conveying said liquid solvent extracted solids and associated solvent to a fluidized bed solvent recovery contactor, said solids fluidized by fluidizing gas comprising superheated vapor of said solvent vaporizing an additional portion of said associated solvent;

discharging said fluidizing gas and additional vaporized solvent from said solids from said fluidized bed solvent recovery contactor and liquefying and recycling said solvent for utilization in said process;

withdrawing said solids containing residual solvent and organic oil from said fluidized bed solvent recovery contactor and conveying said solids containing residual solvent and organic oils to a solids/combustion gas contactor;

countercurrently contacting said solids in said solids/combustion gas contactor with an upwardly flowing combustion gas stream at ambient lower temperature than said solids, physically stripping solvent from said solids and heating said combustion gas, combusting said combustion gas comprising stripped solvent in a solvent vapor superheater for producing said superheated vaporized solvent; and discharging spent solids having reduced residual solvent from said solids/combustion gas contactor.

2. The process of claim 1 wherein said solids are selected from the group consisting of oil shale, limestone containing organic oils, limestone containing organic residues, sandstone containing organic oils, sandstone containing organic residues, tar sands containing bitumen, tar sands containing tar, peat containing wax, peat containing oil, lignite containing wax, lignite containing oil, spent solids containing combustible material, and mixtures thereof.

3. The process of claim 1 wherein said solids have average particle diameters about 0.01 inch to about 0.25 inch.

4. The process of claim 1 wherein said solids have average particle diameters about 0.1 inch to about 0.2 inch.

5. The process of claim 1 wherein said superheated vapor of said solvent is at a superheat temperature higher than about 200° F. above said solvent boiling point.

6. The process of claim 1 wherein said superheated vapor of said solvent is at a superheat temperature about 50° to about 25° F. below the thermal decomposition temperature of organic materials in said solids.

7. The process of claim 1 wherein retention time of said solids in said fluidized bed is about 1 to about 5 minutes.

8. The process of claim 1 wherein retention time of said solids in said fluidized bed is about 2 to about 3 minutes.

9. The process of claim 1 wherein said residual and organic oil is less than about 5 percent of the solvent associated with said liquid solvent extracted solids.

10. The process of claim 1 wherein said spent solids comprise less than about 15 percent of said organic oils and residues present after said solvent extraction.

11. The process of claim 1 wherein said spent solids comprise less than about 1 percent of said organic oils and residues present after said solvent extraction.

12. In a process for organic solvent recovery from solvent extracted inorganic solids from which a substantial portion of organic solvent soluble organic oils and residues have been removed and having remaining associated organic solvent, the improvement comprising: fluidizing a bed of said organic solvent extracted inorganic solids having remaining associated organic solvent with fluidizing gas comprising superheated vapor of said organic solvent vaporizing and removing a substantial portion of said associated organic solvent and then countercurrently contacting said inorganic solids having residual associated organic solvent with a combustion gas stream at a lower temperature than said solids physically stripping a substantial portion of said residual solvent from said solids, said combustion gas stream enhanced for combustion by comprising stripped organic solvent and being heated.

13. The process of claim 12 wherein said solids are selected from the group consisting of oil shale, limestone containing organic oils, limestone containing organic residues, sandstone containing organic oils, sandstone containing organic residues, tar sands containing bitumen, tar sands containing tar, peat containing wax, peat containing oil, lignite containing wax, lignite containing oil, spent solids containing combustible material, and mixtures thereof.

14. The process of claim 12 wherein said solids have average particle diameters about 0.01 inch to about 0.25 inch.

15. The process of claim 12 wherein said solids have average particle diameters about 0.1 inch to about 0.2 inch.

16. The process of claim 12 wherein said superheated vapor of said solvent is at a superheat temperature higher than about 200° F. above said solvent boiling point.

17. The process of claim 12 wherein said superheated vapor of said solvent is at a superheat temperature about 50° to about 25° F. below the thermal decomposition temperature of organic materials in said solids.

18. The process of claim 12 wherein retention time of said solids in said fluidized bed is about 1 to about 5 minutes.

19. The process of claim 12 wherein retention time of said solids in said fluidized bed is about 2 to about 3 minutes.

20. The process of claim 12 wherein said residual and organic oil is less than about 5 percent of the solvent associated with said liquid solvent extracted solids.

21. The process of claim 12 wherein said spent solids comprise less than about 15 percent of said organic oils and residues present after said solvent extraction.

22. The process of claim 12 wherein said spent solids comprise less than about 1 percent of said organic oils and residues present after said solvent extraction.

* * * * *